US008415283B2

(12) United States Patent
Kurihara et al.

(10) Patent No.: US 8,415,283 B2
(45) Date of Patent: Apr. 9, 2013

(54) LUBRICATING OIL COMPOSITION FOR DIESEL ENGINE

(75) Inventors: Isao Kurihara, Yokohama (JP); Mineo Kagaya, Fujisawa (JP)

(73) Assignees: Nippon Oil Corporation, Tokyo (JP); Japan Petroleum Energy Center, Tokyo (JP)

( * ) Notice: Subject to any disclaimer, the term of this patent is extended or adjusted under 35 U.S.C. 154(b) by 0 days.

(21) Appl. No.: 12/708,688

(22) Filed: Feb. 19, 2010

(65) Prior Publication Data

US 2010/0147238 A1 Jun. 17, 2010

Related U.S. Application Data

(63) Continuation of application No. 10/598,980, filed as application No. PCT/JP2005/004617 on Mar. 16, 2005, now abandoned.

(30) Foreign Application Priority Data

Mar. 19, 2004 (JP) ..... 2004-081147

(51) Int. Cl.
*C10M 141/00* (2006.01)
*F01M 9/00* (2006.01)

(52) U.S. Cl. ..... 508/460; 508/192; 508/518; 123/1 A; 44/300

(58) Field of Classification Search ..... 508/192, 508/460
See application file for complete search history.

(56) References Cited

U.S. PATENT DOCUMENTS

| | | | | |
|---|---|---|---|---|
| 5,672,570 | A | 9/1997 | Miyaji et al. | |
| 5,965,495 | A | 10/1999 | Goto et al. | |
| 6,323,162 | B1 | 11/2001 | Yasunori et al. | |
| 6,423,670 | B2 | 7/2002 | Locke et al. | |
| 6,569,818 | B2 | 5/2003 | Nakazato et al. | |
| 6,638,897 | B2 | 10/2003 | Ogano et al. | |
| 6,642,189 | B2 * | 11/2003 | Kurihara et al. | 508/364 |
| 6,720,293 | B2 | 4/2004 | Bovington et al. | |
| 6,764,982 | B2 * | 7/2004 | Bardasz et al. | 508/293 |
| 6,962,614 | B2 | 11/2005 | Katafuchi | |
| 7,026,273 | B2 | 4/2006 | Robson et al. | |
| 7,208,078 | B2 | 4/2007 | Weissman et al. | |
| 7,612,025 | B2 * | 11/2009 | Kurihara et al. | 508/502 |
| 2003/0216266 | A1 | 11/2003 | Hirano et al. | |
| 2004/0171500 | A1 | 9/2004 | Morita | |
| 2004/0176260 | A1 | 9/2004 | Shirahama et al. | |
| 2004/0235682 | A1 | 11/2004 | Van Dam et al. | |
| 2005/0034358 | A1 | 2/2005 | Katafuchi | |
| 2006/0080954 | A1 | 4/2006 | Bardasz | |

FOREIGN PATENT DOCUMENTS

| | | | |
|---|---|---|---|
| EP | 0562172 | A1 | 9/1993 |
| EP | 1167497 | A2 | 1/2002 |
| JP | 03-062893 | | 3/1991 |
| JP | 06-049476 | | 2/1994 |
| JP | 07-010273 | | 1/1995 |
| JP | 08-048989 | | 2/1996 |
| JP | 8-253782 | | 10/1996 |
| JP | 09-111275 | | 4/1997 |
| JP | 2000-063876 | | 2/2000 |
| JP | 2000-119680 | | 4/2000 |
| JP | 2000-2566990 | | 9/2000 |
| JP | 2003-165992 | | 6/2003 |
| JP | 2003-277782 | | 10/2003 |
| JP | 2003-292982 | | 10/2003 |
| JP | 2003-336089 | | 11/2003 |
| JP | 2004-035652 | | 2/2004 |
| JP | 2005-146285 | | 6/2005 |

OTHER PUBLICATIONS

Effect of Engine Oil Composition on DPF Clogging, Preprints for JAST International Tribology Forum, Japanese Society of Tribologists, Oct. 20, 2003, p. 437-438.
European Search Report dated Jan. 27, 2010, in counterpart EP Application No. 05720871.2.
Alan Bunting; Springing the Trap; Automotive Engineer, Professional Engineering Publishing ; XP-000936087; Emissions; vol. 25, No. 5, pp. 73-74, May 2000.

* cited by examiner

*Primary Examiner* — Ellen McAvoy
(74) *Attorney, Agent, or Firm* — Sughrue Mion, PLLC

(57) ABSTRACT

The invention provides lubricant compositions for diesel engines having a regenerative DPF, which prolong life of the DPF by inhibiting accumulation of components depositable on DPF inner walls, diesel engine systems having a regenerative DPF with prolonged life, and a method for inhibiting accumulation of components depositing on the DPF in the system. The present composition is for diesel engines having a regenerative DPF and running on diesel fuel with <10 mass ppm sulfur, contains a base oil and additives including (A) metal detergent, (B) ashless dispersant, and (C) phosphorus-based anti-wear agent, and satisfies the conditions of a sulfated ash content of 0.4-2 mass %, an atomic ratio of metal from component (A) to the total phosphorus of 0.2-3, an atomic ratio of the total boron to metal from component (A) of 0.2-2, and an atomic ratio of the total sulfur to metal from component (A) of 0-4.

4 Claims, No Drawings

LUBRICATING OIL COMPOSITION FOR DIESEL ENGINE

CROSS REFERENCE TO RELATED APPLICATIONS

This is a continuation of application Ser. No. 10/598,980 filed Feb. 9, 2007, which is a 371 of PCT International Application No. PCT/JP2005/004617 filed Mar. 16, 2005.

FIELD OF ART

The present invention relates to a lubricant composition for a diesel engine equipped with a regenerative DPF, a diesel engine system equipped with a regenerative DPF with prolonged life, and a method for inhibiting accumulation of depositing components on a regenerative DPF in such a system.

BACKGROUND ART

Emission regulations have become more and more strict every year over the world in light of environmental problems. Inparticular, it is imperative to reduce NOx and particulate matters (PM) in the exhaust gas from diesel engines. For reducing such exhaust gas, combustion improvement technologies, such as high-pressure injection and exhaust gas recirculation (EGR) systems, or exhaust gas treatment technologies, such as oxidation catalysts, diesel particulate filters (DPF), and NOx storage reduction catalysts, have been under development.

DPFs, which are used for capturing and removing PM in exhaust gas with a filter, have various structures. For example, a wall-flow type DPF has a structure wherein the two ends of a honeycomb monolith are alternately plugged. However, this type of a DPF has problems in that the captured PM accumulates to increase pressure loss, lower engine power, or deteriorate fuel efficiency. For solving such problems, a DPF per se is replaced after a certain mileage, or detached and regenerated to remove PM by oxidization and combustion. Recently, continuous regenerative DPFs have been developed that are intended for mounting on vehicles and continuously regenerated while driving.

Motor vehicle diesel fuels have been in compliance with regulations with regard to SOx, NOx, and PM, and their sulfur content has gradually been reduced from 0.2 mass % to 0.05 mass %. Recently, diesel oils with 0.005 mass % sulfur have become popular.

Lubricants for diesel engines contain lubricant base oil and various additives blended therein, which include various active components, such as metals, sulfur, and phosphorus. For example, JP-6-49476-A, JP-7-10273-A, JP-8-48989-A, JP-2000-119680-A, JP-2000-256690-A, and JP-3-62893-A propose low-ash lubricants for diesel engines with lowered metal contents for reducing PM accumulation on a DPF.

Low-ash lubricants for diesel engines proposed so far are effective in reducing ash settlement on a DPF. However, it has been revealed that deposition of ash on a DPF cannot be inhibited merely by lowering the ash content. Such deposited ash cannot be removed easily by back flushing operation by means of air blow in the regeneration. The deposited ash has severe impact on the lifespan of a DPF, particularly of a continuous regenerative DPF. Thus control of formation of the depositing ash is essential. However, details of the depositing ash formation has not been fully investigated so far, and little report has been made to date on actual evaluation and optimization of the impact of fuel and lubricant on diesel engines equipped with a regenerative DPF.

SUMMARY OF THE INVENTION

It is an object of the present invention to provide a lubricant composition for a diesel engine equipped with a regenerative DPF, which is capable of prolonging life of the DPF not by reducing the ash content of a lubricant to reduce the absolute amount of particulate matters accumulated on the DPF, but by inhibiting accumulation of components that are easily depositable on the inner walls of the regenerative DPF.

It is another object of the present invention to provide a diesel engine system equipped with a regenerative DPF with prolonged life, and a method for inhibiting accumulation of a depositing component on a regenerative DPF in such a system, wherein accumulation of components that are easily depositable on the inner walls of the regenerative DPF may be inhibited, and removal of the components accumulated on the regenerative DPF may easily be made.

The present inventors have made intensive researches for solving the above problems, to find out that, in a diesel engine equipped with a regenerative DPF, when diesel fuel with not more than 10 mass ppm sulfur is used as fuel, a lubricant composition containing particular components at a ratio in a particular range, is capable of remarkably inhibiting accumulation of depositing components on a DPF, and of facilitating removal of the accumulated components, to thereby complete the present invention. When diesel fuel with more than 10 mass ppm sulfur is used, such a remarkable effect is not observed.

According to the present invention, there is provided a lubricant composition for a diesel engine, said diesel engine being equipped with a regenerative DPF and running on diesel fuel with not more than 10 mass ppm sulfur, said lubricant composition comprising:

a lubricant base oil, and additives including:

(A) a metal detergent, (B) an ashless dispersant, and (C) a phosphorus-based anti-wear agent, wherein said lubricant composition satisfies all of the following conditions (1) to (4):

(1) a sulfated ash content of 0.4 to 2 mass %, (2) an atomic ratio of metal derived from component (A) to the total phosphorus (M/P ratio) of 0.2 to 3, (3) an atomic ratio of the total boron to metal derived from component (A) (B/M ratio) of 0.2 to 2, and (4) an atomic ratio of the total sulfur to metal derived from component (A) (S/M ratio) of 0 to 4.

According to the present invention, there is also provided a diesel engine system running on diesel fuel with not more than 10 mass ppm sulfur, said system comprising a regenerative DPF and the above lubricant composition for a diesel engine as an engine lubricant.

According to the present invention, there is further provided a method for inhibiting accumulation of a depositing component on a regenerative DPF in a diesel engine system, said method comprising running said engine system on diesel fuel with not more than 10 mass ppm sulfur, and operating said engine system using a lubricant comprising the above lubricant composition for a diesel engine.

According to the present invention, there is also provided a method for facilitating removal of a component accumulated on a regenerative DPF in a diesel engine system, said method comprising running said engine system on diesel fuel with not more than 10 mass ppm sulfur, and operating said engine system using a lubricant comprising the above lubricant composition for a diesel engine.

According to the present invention, there is also provided use of the above lubricant composition for a diesel engine for the lubrication of a diesel engine that is equipped with a regenerative DPF and runs on diesel fuel with not more than 10 mass ppm sulfur.

According to the present invention, there is further provided use of the above lubricant composition for a diesel engine for the inhibition of accumulation of a depositing component on a regenerative DPF in a diesel engine running on diesel fuel with not more than 10 mass ppm sulfur.

According to the present invention, there is further provided use of the lubricant composition for a diesel engine for the facilitation of removal of a component accumulated on a regenerative DPF in a diesel engine running on diesel fuel with not more than 10 mass ppm sulfur.

Since the lubricant composition for a diesel engine according to the present invention contains (A) a metal detergent, (B) an ashless dispersant, and (C) a phosphorus-based antiwear agent, and has particular properties, the composition, when used in a diesel engine running on diesel fuel with not more than 10 mass ppm sulfur, inhibits accumulation of a component that easily deposits on the inner walls of a regenerative DPF, and facilitates removal of the component accumulated on the regenerative DPF, to thereby prolong life of the DPF. Thus the lubricant composition for a diesel engine according to the present invention is particularly useful in a diesel engine system equipped with a regenerative DPF, inparticular a continuous regenerative DPF, and in a method for inhibiting accumulation of a depositing component on a DPF.

PREFERRED EMBODIMENTS OF THE INVENTION

The present invention will now be explained in detail.

The lubricant base oil used in the lubricant composition for a diesel engine according to the present invention (sometimes referred to simply as a lubricant composition or a composition hereinbelow) is not particularly limited, and may be a mineral base oil and/or a synthesized base oil that are commonly used in lubricants.

The mineral base oil may be, for example, a lubricant base oil prepared by atmospheric distilling crude oil, further distilling the atmospheric residue under reduced pressure, and refining the resulting lubricant fraction by at least one of solvent deasphalting, solvent extraction, hydrocracking, solvent dewaxing, and hydrorefining; or a wax-isomerized mineral oil or a lubricant base oil prepared by isomerization of GTL WAX (gas-to-liquid wax).

The sulfur content of the mineral base oil is not particularly limited as long as it satisfies the conditions of the present invention, and may be, for example, usually not higher than 1 mass %, preferably not higher than 0.2 mass %, more preferably not higher than 0.1 mass %, still more preferably not higher than 0.005 mass %.

It is preferred that the mineral base oil consists mainly of, or contains usually not less than 70 mass % of, preferably not less than 80 mass % of, more preferably not less than 90 mass % of, or consists solely of, a mineral base oil with not more than 0.001 mass % sulfur. By reducing the sulfur content of the mineral base oil, formation of the components depositing on a DPF is conveniently inhibited, and removal of the components accumulated on a DPF is facilitated.

The total aromatics of the mineral base oil is not particularly limited, and may be usually not more than 50 mass %, preferably not more than 15 mass %, more preferably not more than 10 mass %, and still more preferably not more than 8 mass %. A mineral base oil with about 0 mass % total aromatics may also be used preferably. However, in view of the solubility of the additives or sludge, the total aromatics are usually not less than 1 mass %, preferably not less than 2 mass %, more preferably not less than 3 mass %, most preferably not less than 5 mass %. With the total aromatics of the mineral base oil of not more than 15 mass %, a composition with superior oxidation stability may be obtained.

As used herein, the total aromatics refer to a content of an aromatic fraction as measured in accordance with ASTMD2549. The aromatic fraction usually includes alkylbenzene and alkylnaphthalene, as well as anthracene, phenanthrene, and alkylation products thereof; compounds obtained by condensing not less than four benzene rings; or compounds having a heteroaromatic, such as pyridines, quinolines, phenols, and naphthols.

Examples of the synthetic base oil may include polybutene or hydrides thereof; poly-α-olefins, such as 1-octene oligomer or 1-decene oligomer, or hydrides thereof; diesters, such as ditridecyl glutarate, di-2-ethylhexyl adipate, diisodecyl adipate, ditridecyl adipate, or di-2-ethylhexyl sebacate; polyol esters, such as neopentyl glycol esters, trimethylolpropane caprylate, trimethylolpropane pelargonate, pentaerythritol-2-ethylhexanoate, or pentaerythritol pelargonate; aromatic synthetic oils, such as alkylnaphthalene, alkylbenzene, or aromatic esters; and mixtures of two or more of these.

The lubricant base oil used in the present invention may be the above-mentioned mineral base oil, above-mentioned synthetic base oil, or an arbitrary mixture of two or more oils selected from these. For example, one or more mineral base oils, one or more synthetic base oils, or a mixed oil of one or more mineral base oils and one or more synthetic oils, may be used.

The kinematic viscosity of the lubricant base oil used in the present invention is not particularly limited, and may preferably be not lower than 3 $mm^2/s$ and not higher than 20 $mm^2/s$, more preferably not lower than 4 $mm^2/s$ and not higher than 10 $mm^2/s$, still more preferably not lower than 5 $mm^2/s$ and not higher than 7 $mm^2/s$, most preferably not lower than 6 $mm^2/s$ and not higher than 7 $mm^2/s$ at 100° C. If the kinematic viscosity is over 20 $mm^2/s$, the low-temperature viscosity is deteriorated. If the kinematic viscosity is less than 3 $mm^2/s$, a sufficient oil film is not formed at the lubricating site, which results in inferior lubricity and great evaporation loss of the lubricant base oil, which are not preferable.

The evaporation loss of the lubricant base oil is preferably not more than 20 mass %, more preferably not more than 18 mass %, most preferably not more than 10 mass %, in NOACK evaporative loss. If the NOACK evaporative loss of the lubricant base oil is over 20 mass %, not only the evaporation loss of the lubricant oil is great, but also sulfur or phosphorus compounds or metals in the composition may settle on the DPF together with the lubricant base oil, which may have disadvantageous impact on formation of the depositing components. As used herein, the NOACK evaporative loss is measured in accordance with CECL-40-T-87.

The viscosity index of the lubricant base oil is not particularly limited, and may usually be not lower than 80, preferably not lower than 100, more preferably not lower than 120, most preferably not lower than 130, so as to achieve excellent viscosity property from low temperatures to high temperatures. A viscosity index of less than 80 adversely affects the low-temperature viscosity property, thus being not preferred.

Component (A) of the present composition is a metal detergent. Examples of component (A) may include metal detergents, such as sulfonates, phenates, or salicylates of alkali metals or alkaline earth metals.

As component (A), alkali metal or alkaline earth metal sulfonate detergents and/or alkali metal or alkaline earth metal salicylate detergents may preferably be used, with the alkali metal or alkaline earth metal salicylate detergents being more preferred. It is particularly preferred to use an alkali metal or alkaline earth metal salicylate containing usually not less than 55 mol %, preferably not less than 60 mol % of at least one compound represented by the formula (1), and/or overbased or basic salts of such salicylate, for excellent solubility in the lubricant base oil and storage, stability.

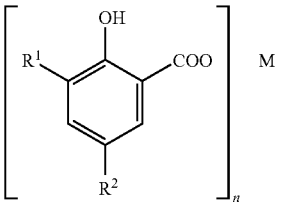

(1)

wherein $R^1$ stands for an alkyl group having 1 to 40 carbon atoms, $R^2$ stands for a hydrogen atom or an alkyl group having 1 to 40 carbon atoms, M stands for an alkali metal or alkaline earth metal, such as sodium, potassium, magnesium, barium, or calcium, with magnesium and/or calcium being preferred, n denotes 1 or 2 depending on the valence of metal M.

Examples of the alkyl group having 1 to 40 carbon atoms may include methyl, ethyl, propyl, butyl, pentyl, hexyl, heptyl, octyl, nonyl, decyl, undecyl, dodecyl, tridecyl tetradecyl, pentadecyl, hexadecyl, heptadecyl, octadecyl, nonadecyl, icosyl, henicosyl, docosyl, tricosyl, tetracosyl, pentacosyl, hexacosyl, heptacosyl, octacosyl, nonacosyl, and triacontyl groups, which may either be straight or branched.

Among the alkyl groups having 1 to 40 carbon atoms, in particular alkyl groups having 10 to 40 carbon atoms, secondary alkyl groups having 10 to 40 carbon atoms derived from a polymer or a copolymer of ethylene, propylene, 1-butene, or the like, in particular secondary alkyl groups having 10 to 40 carbon atoms derived from an ethylene polymer are preferred, and secondary alkyl groups having 14 to 18 carbon atoms are particularly preferred.

The alkali metal or alkaline earth metal salicylate as component (A) may preferably be an alkali metal or alkaline earth metal salicylate containing in total of not less than 55 mol %, preferably not less than 60 mol % of compound (A-1) represented by the formula (1) wherein $R^1$ stands for a secondary alkyl group having 10 to 19 carbon atoms, and $R^2$ stands for a hydrogen atom, and compound (A-2) represented by the formula (1) wherein. $R^1$ and $R^2$ each stands for a secondary alkyl group having 10 to 19 carbon atoms, for its excellent solubility and storage stability. Moreover, an alkali metal or alkaline earth metal salicylate composed mainly of, for example containing not less than 85 mol % of, preferably not less than 90 mol % of monoalkyl salicylate is particularly preferred for excellent low-temperature fluidity.

The compositional ratio of compounds (A-1) and (A-2) is usually not less than 40 mol %, preferably not less than 50 mol % of compound (A-1), and usually not more than 15 mol %, preferably not more than 10 mol % of compound (A-2). The molar ratio of compound (A-2) to compound (A-1) ((A-2)/(A-1)) is not particularly limited, and may preferably be not higher than 0.3, more preferably not higher than 0.2 for excellent low-temperature fluidity.

As component (A), an overbased metal detergent containing an overbased or basic salt, such as calcium carbonate and/or calcium borate, may preferably be used. The base number thereof is usually 150 to 500 mgKOH/g. When a salicylate detergent is used, its base number is preferably 150 to 400 mgKOH/g, more preferably 150 to 200 mgKOH/g, whereas when a sulfonate or phenate detergent is used, its base number is preferably 200 to 500 mgKOH/g, more preferably 250 to 400 mgKOH/g. As used herein, the base number refers to a base number as measured by perchloric acid method in accordance with 7. in JIS K2501 "Petroleum products and lubricants—Determination of neutralization number".

The content of component (A) in the present composition is not particularly limited, as long as the content of the sulfated ash, the M/P ratio, the B/M ratio, and the S/M ratio of the composition fall within the ranges defined in the present invention. The content of component (A) in terms of alkali metal or alkaline earth metal is usually not less than 0.01 mass % and not more than 0.5 mass %, preferably not less than 0.05 mass % and not more than 0.3 mass %, more preferably not less than 0.15 mass % and not more than 0.2 mass % of the total amount of the composition.

Component (B) of the present composition is an ashless dispersant. Examples of component (B) may include a nitrogen-containing compound having in its molecule at least one straight or branched alkyl or alkenyl group having 40 to 400, preferably 60 to 350 carbon atoms, and derivatives thereof; more specifically, succinimide, benzylamine, polyamine, or the like, and derivatives thereof obtained by modification with boron, phosphorus, sulfur, organic acid, or the like. For use, any one or more of these examples may be blended.

With an alkyl or alkenyl group having less than 40 carbon atoms, the solubility of component (B) in the lubricant base oil is low, whereas with more than 400 carbon atoms, the low-temperature fluidity of the lubricant composition is declined, thus not being preferred. The alkyl or alkenyl group may either be straight or branched, and may preferably be a branched alkyl or alkenyl group derived from an oligomer of olefins, such as propylene, 1-butene, or isobutylene, or a co-oligomer of ethylene and propylene.

As component (B), a boron-containing ashless dispersant may be used, which may preferably be, for example, boron-containing poly(iso)butenyl succinimide. There are monotype and bis-type poly(iso)butenyl succinimides, either of which may be used, but the latter is particularly preferred.

The content of component (B) in the present composition is not particularly limited, and may be usually not less than 0.01 mass % and not more than 0.4 mass %, preferably not less than 0.02 mass % and not more than 0.2 mass %, more preferably not less than 0.02 mass % and not more than 0.15 mass % of the total amount of the composition, in terms of nitrogen.

The content of boron derived from component (B) in the present composition is not particularly limited, as long as the B/M ratio falls within the range defined in the present invention as will be discussed, later, and may be usually not less than 0.015 mass % and not more than 0.2 mass %, preferably not less than 0.018 mass % and less than 0.1 mass %, more preferably less than 0.04 mass %, particularly preferably not more than 0.03 mass %. At the content of boron derived from component (B) of not less than 0.015 mass %, remarkable effect is achieved, and at not less than 0.04 mass %, remarkable improvement in the effect is not observed. Thus, taking the increase in sulfated ash or the cost into consideration, the boron content is most preferably not less than 0.015 mass % and less than 0.04 mass %.

It is preferred to combine in component (B) a boron-free ashless dispersant, in particular, a boron-free succinimide ashless dispersant. The content thereof is not particularly limited, and preferably not less than 0.01 mass % and less than 0.08 mass %, more preferably not less than 0.02 mass % and not more than 0.07 mass % of the total amount of the composition, in terms of nitrogen.

Incidentally, the mass ratio of boron to nitrogen (B/N ratio) in component (B) is not particularly limited, and may be usually not lower than 0.1 and not higher than 0.5, preferably not lower than 0.14 and not higher than 0.3, more preferably not higher than 0.2.

Component (C) of the present composition is a phosphorus-based anti-wear agent, which may be a conventional phosphorus-based anti-wear agent used in lubricants.

Examples of component (C) may include phosphates, phosphites, thiophosphates, and thiophosphites; derivatives thereof; metal salts thereof; and amine salts thereof. Among these examples, metal mono- or dihydrocarbyl dithiophosphate and/or metal mono- or dihydrocarbyl phosphate are preferred.

Examples of the metal in the metal salts may include zinc, molybdenum, alkali metals, and alkaline earth metals, with zinc being particularly preferred.

The amine in the amine salts may be an amine compound having a hydrocarbon group with 1 to 30, preferably 8 to 24 carbon atoms. The hydrocarbon group may preferably be an alkyl or alkenyl group.

The hydrocarbyl group may preferably has a hydrocarbon group with 1 to 30, preferably 3 to 8, more preferably 3 to 6 carbon atoms, and the hydrocarbon group may preferably be a primary or secondary alkyl group, with the latter being particularly preferred.

As component (C), zinc dialkyldithiophosphate having an alkyl group with 3 to 8 carbon atoms may preferably be used for its abilities to give a composition with particularly excellent anti-wear property, and to inhibit formation of the components depositing on a DPF. Further, zinc dialkylphosphate having an alkyl group with 3 to 8 carbon atoms may particularly preferably be used for not only its ability to inhibit formation of the components depositing on a DPF, but also for its excellently low sulfur content and long drain interval, and ability to give a low-sulfur lubricant, which results in minimized impact of sulfur poisoning on a catalyst for purifying exhaust gas.

The content of component (C) in the present composition is not particularly limited, and may be usually not less than 0.01 mass % and not more than 0.2 mass %, preferably not less than 0.04 mass % and not more than 0.15 mass %, more preferably not less than 0.08 mass % and not more than 0.15 mass %, particularly preferably not less than 0.1 mass % and not more than 0.15 mass % of the total amount of the composition, in terms of phosphorus.

It is essential for the lubricant composition of the present invention not only to contain the above components (A) to (C), but also to have the properties that satisfy all of the following conditions (1) to (4):

(1) a sulfated ash content of 0.4 to 2 mass %, (2) an atomic ratio of metal derived from component (A) to the total phosphorus (M/P ratio) of 0.2 to 3, (3) an atomic ratio of the total boron to metal derived from component (A) (B/M ratio) of 0.2 to 2, and (4) an atomic ratio of the total sulfur to metal derived from component (A) (S/M ratio) of 0 to 4.

The sulfated ash content as condition (1) may be more than 0.8 mass % and not more than 1.2 mass %, preferably not less than 0.9 mass % and not more than 1.1 mass %, more preferably not less than 1.0 mass % and not more than 1.1 mass %, depending on the desired performance of the composition or the standard for diesel engine oil. In this case, the M/P ratio as condition (2) is 0.2 to 3, preferably not lower than 1 and not higher than 2.5, more preferably not lower than 1.2 and not higher than 2, still more preferably not lower than 1.2 and not higher than 1.6; the B/M ratio as condition (3) is 0.2 to 2, preferably not lower than 0.25 and not higher than 1.2, more preferably not lower than 0.3 and not higher than 0.7, still more preferably not lower than 0.3 and not higher than 0.6; and the S/M ratio as condition (4) is 0 to 4, preferably not lower than 0.2 and not higher than 3, more preferably not lower than 1 and not higher than 2.2, still more preferably not lower than 1.5 and not higher than 2.

The sulfated ash content as condition (1) may be 0.4 to 0.8 mass %, preferably not less than 0.45 mass % and not more than 0.6 mass %, more preferably not less than 0.5 mass % and not more than 0.55 mass %, depending on the desired performance of the composition or the standard for diesel engine oil. In this case, the M/P ratio as condition (2) is 0.2 to 3, preferably not lower than 0.4 and not higher than 2, more preferably not lower than 0.6 and not higher than 1.5, still more preferably not lower than 0.6 and not higher than 1; the B/M ratio as condition (3) is 0.2 to 2, preferably not lower than 0.5 and not higher than 2.5, more preferably not lower than 0.8 and not higher than 1.5, still more preferably not lower than 0.8 and not higher than 1.2; and the S/M ratio as condition (4) is 0 to 4, preferably not lower than 0.5 and not higher than 3.8, more preferably not lower than 1.5 and not higher than 3.8, still more preferably not lower than 3 and not higher than 3.8.

The sulfated ash content as condition (1) may be more than 1.2 mass % and not more than 2 mass %, preferably not less than 1.3 mass % and not more than 1.6 mass %, more preferably not less than 1.4 mass % and not more than 1.5 mass %, depending on the desired performance of the composition or the standard for diesel engine oil. In this case, the M/P ratio as condition (2) is 0.2 to 3, preferably not lower than 1.5 and not higher than 3, more preferably not lower than 2 and not higher than 2.6; the B/M ratio as condition (3) is 0.2 to 2, preferably not higher than 1, more preferably not higher than 0.5, still more preferably not higher than 0.4; and the S/M ratio as condition (4) is 0 to 4, preferably not lower than 0.2 and not higher than 2, more preferably not lower than 0.8 and not higher than 1.5.

The lubricant composition for a diesel engine according to the present invention, with the above components, inhibits formation of the depositing components to be accumulated on a regenerative DPF, in particular a continuous regenerative DPF, inhibits generation of differential pressure after regeneration, and as a result, prolongs the life of the DPF, which otherwise be terminated by clogging. However, when diesel fuel having a sulfur content of well over 10 mass ppm, for example, about 50 mass ppm or higher, is used, the composition cannot fully exhibit its effect. Thus, it is necessary to apply the present composition to a diesel engine that runs on diesel fuel with not more than 10 mass ppm, preferably not more than 5 mass ppm sulfur. When such fuel is used, formation of the components depositing on a DPF may be inhibited remarkably.

The diesel fuel with not more than 10 mass ppm sulfur is not particularly limited, and may be mineral oil fuel highly refined by desulfulization, such as kerosene or diesel oil having a sulfur content of not more than 10 mass ppm; so called biodiesel fuel, such as alkyl esters of saturated or unsaturated fatty acids; or fuel substantially free of sulfur, such as dimethyl ether (DME), GTL (gas-to-liquid) kerosene or GTL diesel oil synthesized by Fischer-Tropsch reaction or the like.

The lubricant composition for a diesel engine according to the present invention may optionally contain additives for lubricants, for example, suitably selected one or more of anti-oxidants, friction modifiers, anti-wear agents other than component (C), viscosity index improvers, corrosion inhibitors, rust inhibitors, demulsifiers, metal deactivators, foam inhibitors, and coloring agents.

Examples of the anti-oxidants may include conventional phenol or amine anti-oxidants.

Examples of the friction modifiers may include organic molybdenum compounds, such as molybdenum dithiocarbamate or molybdenum dithiophosphate, and ashless friction modifiers, such as fatty acids, fatty acid esters, fatty acid amines, fatty acid ethers, and fatty acid amides, all having an alkyl or alkenyl group with 6 to 30 carbon atoms.

Examples of the anti-wear agents other than component (C) may include sulfur-containing anti-wear agents, such as sulfurized oils and fats, sulfuric esters, sulfurized olefins, polysulfides, dithiocarbamate, and zinc dithiocarbamate.

Examples of the viscosity index improvers may include conventional polymethacrylate, ethylene-α-olefin copolymer, styrene-diene copolymer, or poly(iso)butene viscosity index improvers, having a weight average molecular weight of 1000 to 1000000.

Examples of the corrosion inhibitors may include benzotriazole, tolyltriazole, thiadiazole, or imidazole compounds.

Examples of the rust inhibitors may include petroleum sulfonate, alkylbenzene sulfonate, dinonylnaphthalene sulfonate, alkenyl succinate, and esters of polyhydric alcohols.

Examples of the demulsifiers may include polyalkylene glycol nonionic surfactants, such as polyoxyethylene alkyl ether, polyoxyethylene alkylphenyl ether, and polyoxyethylene alkylnaphthyl ether.

Examples of the metal deactivators may include imidazoline, pyrimidine derivatives, alkylthiadiazole, mercaptobenzothiazole, benzotriazole or derivatives thereof, 1,3,4-thiadiazole polysulfide, 1,3,4-thiadiazolyl-2,5-bisdialkyl dithicarbamate, 2-(alkyldithio)benzoimidazole, and β-(o-carboxybenzylthio)propionitrile.

Examples of the foam inhibitors may include silicone, fluorosilicone, fluoroalkyl ethers.

The contents of these optional additives in the lubricant composition of the present invention may be 0.01 to 5 mass % for each of anti-oxidants, friction modifiers, and anti-wear agents other than component (C), 0.1 to 15 mass % for viscosity index improvers, 0.005 to 5 mass % for each of corrosion inhibitors, rust inhibitors, and demulsifiers, 0.005 to 1 mass % for metal deactivators, and 0.0005 to 1 mass % for foam inhibitors.

The diesel engine system according to the present invention is equipped with a regenerative DPF inparticular a continuous regenerative DPF, runs on diesel fuel with not more than 10 mass ppm sulfur, and employs the lubricant composition according to the present invention as a lubricant composition for this system, so that accumulation of the depositing components on the regenerative DPF is inhibited, removal of the components accumulated on the DPF is facilitated, and life of the DPF is prolonged. The system structure may suitably be selected based on the conventional structures.

The regenerative DPF may be combined with a three-way catalyst, oxidation catalyst, NOx storage reduction catalyst, or urea selective reduction catalyst.

The method for inhibiting accumulation of depositing components on a regenerative DPF according to the present invention is for inhibiting accumulation of depositing components on a regenerative DPF, inparticular a continuous regenerative DPF, in a diesel engine system running on diesel fuel with not more than 10 mass ppm sulfur, and is performed by using, as a lubricant for the diesel engine system, a lubricant containing the lubricant composition according to the present invention discussed above. With this method, the life of a DPF may be prolonged.

EXAMPLES

The present invention will now be explained in more detail with reference to Examples and Comparative Examples, which do not intend to limit the present invention. Examples 1 to 7 and Comparative Examples 1 to 4

Lubricants for a diesel engine having the compositions as shown in Table 1 were prepared, wherein the compositions in Example 6 and Comparative Example 4 were identical.

The lubricant compositions prepared in Examples 1 to 7 and Comparative Examples 1 to 3 were subjected to the following test.

A 400 cc single cylinder general purpose diesel engine was used in the test, and an externally regenerative DPF made of silicon carbide was attached to the exhaust outlet. The engine was run at 2400 rpm at ½ load for 100 hours to measure the differential pressure between the inlet and outlet of the DPF. In the test, each lubricant composition shown in Table 1 was placed in the oil pan, and diesel fuel with 4 mass ppm sulfur blended with 4 mass % of a lubricant composition shown in Table 1 from which "other additives" were removed, was used as fuel.

In the test, when the differential pressure between the inlet and outlet of the DPF rose sharply, the soot accumulated on the DPF was combusted in an external regenerative furnace, and the test was resumed without removing the remaining ash, which operation was repeated. The differential pressure immediately after the final regeneration is shown in Table 1 as the result. The soot accumulated on the DPF contained the combustion residues of the fuel and lubricant components blended therein, as well as the combustion residues of the lubricant components mixed into the combustion chamber from the oil pan.

For the lubricant composition of Comparative Example 4 (having the same composition as in Example 6), the process similar to the above was followed, except that diesel fuel with 45 mass ppm sulfur was used as the diesel fuel, and the differential pressure between the inlet and outlet of the DPF immediately after the restart of the test was measured. The results is shown in Table 1.

In Table 1, details of each component are as follows.

1) Lubricant base oil: Hydrocracked mineral oil (kinematic viscosity at 100° C.: 6.5 $mm^2/s$; sulfur content: not higher than 0.0001 mass %; aromatic content: 5.5 mass %; NOACK evaporative loss: 8 mass %; viscosity index: 130)

2) Lubricant base oil: Solvent refined mineral oil (kinematic viscosity at 100° C.: 5.3 $mm^2/s$; sulfur content: 0.35 mass %; viscosity index: 103)

3) Overbased calcium salicylate containing calcium carbonate (total base number: 166 mgKOH/g; calcium content: 5.8 mass %; sulfur content: 0.4 mass %; sulfated ash content: 19.7 mass %; (A-1) 3-alkyl salicylate: 53 mol %; (A-2) 3,5-dialkyl salicylate: 8 mol %, monoalkyl salicylates: 91 mol % in total; alkyl group: C14-C18 secondary alkyl group)

4) Overbased calcium salicylate containing calcium borate (total base number: 190 mgKOH/g; calcium content: 6.8 mass %; boron content: 2.7 mass %; sulfur content: 0.3 mass %; (A-1) 3-alkyl salicylate: 53 mol %, (A-2) 3,5-dialkyl salicylate: 8 mol %, monoalkyl salicylates: 91 mol % in total; alkyl group: C14-C18 secondary alkyl group)

5) Overbased calcium sulfonate containing calcium carbonate (total base number: 300 mgKOH/g; calcium content: 12 mass %; sulfur content: 3.8 mass %; sulfated ash content: 42.5 mass %)

6) Overbased calcium phenate containing calcium carbonate (total base number: 250 mgKOH/g; calcium content: 5.25 mass %; sulfur content: 2.5 mass %; sulfated ash content: 31.5 mass %)

7) Polybutenyl succinimide (bis-type; number average molecular weight of polybutenyl group: 1500; nitrogen content: 1.3 mass %)

8) Borated polybutenyl succinimide (bis-type; number average molecular weight of polybutenyl group: 1300; nitrogen content: 1.6 mass %; boron content: 0.5 mass %)

9) Zinc di(1,3-dimethylbutyl)dithiophosphate (zinc content: 7.8 mass %; phosphorus content: 7.2 mass %; sulfur content: 14.0 mass %)

10) Zinc alkyl phosphate (zinc content: 6.7 mass %; phosphorus content: 6.0 mass %)

11) Additives composed of phenol anti-oxidant, amine anti-oxidant, viscosity index improver, and pour point depressant As clearly seen from Table 1, the lubricant compositions of Examples 1 to 7, when diesel fuel with not more than 10 mass ppm sulfur was used, resulted in low differential pressure across the DPF after regeneration, which leads to the conclusion that formation of depositing components accumulated on the DPF was small.

The lubricant compositions of Examples 1 to 5 and Comparative Examples 1 to 3 with the sulfated ash content of 0.8 to 1.2 mass %, resulted in low differential pressure immediately after the regeneration. In particular, when the salicylate detergent was used, remarkable effect was achieved. The lubricant compositions of Comparative Examples 1 to 3, wherein the B/M and S/M ratios do not satisfy the conditions of the present invention, resulted in high differential pressure immediately after the regeneration, which indicates that the depositing components were easily accumulated.

With the lubricant compositions of Example 6 and Comparative Example 4 having the sulfated ash content of 0.4 to 0.8 mass %, the differential pressure immediately after the regeneration was low when the diesel fuel with not more than 10 mass ppm sulfur was used in Example 6, but the differential pressure immediately after the regeneration was high when the diesel fuel with 45 mass ppm sulfur was used in Comparative Example 4, indicating high tendency of depositing component accumulation.

TABLE 1

| | | Example | | | | | | | Comparative Example | | | |
|---|---|---|---|---|---|---|---|---|---|---|---|---|
| | | 1 | 2 | 3 | 4 | 5 | 6 | 7 | 1 | 2 | 3 | 4 |
| Base oil (A) | Lubricant base oil 1) (mass %) | 100 | 100 | 100 | 100 | 100 | 100 | 100 | 100 | 100 | 43 | 100 |
| | Lubricant base oil 2) (mass %) | — | — | — | — | — | — | — | — | — | 57 | — |
| | Ca salicylate 3) | 3.5 | 3.5 | — | — | — | 1.2 | 6.0 | 3.5 | 3.5 | — | 1.2 |
| | Ca borate salicylate 4) | — | — | 3.0 | — | — | — | — | — | — | — | — |
| | Ca sulfonate 5) | — | — | — | 1.7 | — | — | — | — | — | — | — |
| | Ca phenate 6) | — | — | — | — | 3.8 | — | — | — | — | 1.9 | — |
| | Ca concentration (mass %) | 0.20 | 0.20 | 0.20 | 0.20 | 0.20 | 0.70 | 0.35 | 0.20 | 0.20 | 0.10 | 0.07 |
| | S concentration (mass %) | 0.014 | 0.014 | 0.009 | 0.065 | 0.095 | 0.005 | 0.024 | 0.014 | 0.014 | 0.048 | 0.005 |
| (B) | Alkenyl succinimide 7) | | | | | | | | | | | |
| | N content (mass %) | 0.05 | 0.05 | 0.05 | 0.05 | 0.05 | 0.05 | 0.05 | 0.07 | 0.05 | 0.05 | 0.05 |
| | Borated alkenyl succinimide 8) | | | | | | | | | | | |
| | N content (mass %) | 0.06 | 0.06 | 0.06 | 0.06 | 0.06 | 0.06 | 0.06 | 0.00 | 0.02 | 0.08 | 0.06 |
| | B content (mass %) | 0.020 | 0.020 | 0.020 | 0.020 | 0.020 | 0.020 | 0.020 | 0.000 | 0.007 | 0.025 | 0.020 |
| (C) | Zinc alkyl dithiophosphate 9) | | | | | | | | | | | |
| | P content (mass %) | 0.11 | 0.00 | 0.11 | 0.11 | 0.11 | 0.07 | 0.11 | 0.11 | 0.11 | 0.07 | 0.07 |
| | S content (mass %) | 0.23 | 0.00 | 0.23 | 0.23 | 0.23 | 0.15 | 0.23 | 0.23 | 0.23 | 0.15 | 0.15 |
| | Zinc alkyl phosphate 10) | | | | | | | | | | | |
| | P content (mass %) | — | 0.11 | — | — | — | — | — | — | — | — | — |
| Other additives 11) (mass %) | | 3.8 | 3.8 | 3.8 | 3.8 | 3.8 | 3.8 | 3.8 | 4.0 | 3.8 | 4.3 | 3.8 |
| Total sulfur (S) (mass %) | | 0.29 | 0.06 | 0.29 | 0.34 | 0.37 | 0.21 | 0.30 | 0.29 | 0.29 | 0.43 | 0.21 |
| Total phosphorus (P) (mass %) | | 0.11 | 0.11 | 0.11 | 0.11 | 0.11 | 0.07 | 0.11 | 0.11 | 0.11 | 0.07 | 0.07 |
| Total boron (B) (mass %) | | 0.02 | 0.02 | 0.10 | 0.02 | 0.02 | 0.02 | 0.02 | 0.00 | 0.007 | 0.03 | 0.02 |
| Total alkali/alkaline earth metal (M) (mass %) | | 0.20 | 0.20 | 0.20 | 0.20 | 0.20 | 0.07 | 0.35 | 0.20 | 0.20 | 0.10 | 0.07 |
| Sulfated ash content (mass %) | | 1.0 | 1.0 | 1.2 | 1.0 | 1.0 | 0.5 | 1.5 | 0.9 | 1.0 | 0.6 | 0.5 |
| M/P ratio (atomic ratio) | | 1.46 | 1.46 | 1.46 | 1.46 | 1.43 | 0.75 | 2.50 | 1.46 | 1.43 | 1.07 | 0.75 |
| B/M ratio (atomic ratio) | | 0.36 | 0.36 | 1.83 | 0.36 | 0.37 | 1.06 | 0.21 | 0.00 | 0.13 | 0.93 | 1.06 |
| S/M ratio (atomic ratio) | | 1.80 | 0.39 | 1.76 | 2.10 | 2.34 | 3.71 | 1.08 | 1.80 | 1.80 | 5.44 | 3.71 |
| Evaluation | Number of DPF clogging in test (number of regeneration) | 2 | 2 | 2 | 2 | 3 | 2 | 5 | 3 | 3 | 2 | 2 |
| | DPF differential pressure after test (after regeneration) (kPa) | 0.8 | 0.5 | 0.9 | 1.5 | 1.7 | 0.8 | 1.5 | 8.2 | 6.2 | 4.3 | 3.4 |
| Sulfur content of diesel fuel used (mass %) | | | | | 0.0004 | | | | | 0.0004 | | 0.0045 |

The lubricant composition of Example 7 with the sulfated ash content of 1.2 to 2 mass % required an increased number of regeneration, but the differential pressure across the DPF after the regeneration was low, which leads to the conclusion that the impact of the sulfated ash content in the composition on the formation of the components depositing on the DPF is little, as long as the particular properties defined in the present invention are satisfied.

Incidentally, it is understood from these examples that, even if the sulfated ash content was about 1 mass % or higher (Examples 1 to 5 and 7), the results were comparable to that of Example 6 wherein the sulfated ash content was reduced by half to 0.5 mass %. Further, it was implied that even at the boron content of less than 0.04 mass %, the composition could exhibit sufficient performance, and even at the total boron of 0.1 mass % as in Example 3, the effect thereof was not very different. Thus the composition may be made at a low boron content to inhibit increase of the sulfated ash caused by boron, and to obtain a cost-effective composition.

Accordingly, the lubricant composition for a diesel engine according to the present invention, synergistically with diesel fuel with a remarkably low sulfur content, inhibits accumulation of the depositing components on a regenerative DPF, and remarkably prolongs life of a DPF, which otherwise is terminated by clogging.

What is claimed is:

1. A diesel engine system running on diesel fuel with not more than 10 mass ppm sulfur, comprising a regenerative diesel particulate filters ("DPF") and a lubricant comprising a lubricant composition as an engine lubricant, said lubricant composition comprising:

a lubricant base oil, and additives including:

(A) a metal detergent including at least one of alkaline earth metal salicylate and an overbased or basic salt thereof, (B) an ashless dispersant comprising both a boron-containing ashless dispersant and a boron-free ashless dispersant, and (C) a phosphorus-based anti-wear agent consisting of metal mono- or dihydrocarbyl phosphate, wherein said lubricant composition satisfies all of the following conditions (1) to (4):

(1) a sulfated ash content of 0.4 to 1.2 mass %, (2) an atomic ratio of metal derived from component (A) to the total phosphorus (M/P ratio) of 0.4 to 2, (3) an atomic ratio of the total boron to metal derived from component (A) (B/M ratio) of 0.2 to 2, and (4) an atomic ratio of the total sulfur to metal derived from component (A) (S/M ratio) of 0 to 4, and wherein the composition does not include a thiophosphate.

2. The diesel engine system according to claim 1, wherein said regenerative DPF is a continuous regenerative DPF intended for mounting on a motor vehicle.

3. A method for inhibiting accumulation of a depositing component on a regenerative diesel particulate filter ("DPF") in a diesel engine system, said method comprising running said engine system on diesel fuel with not more than 10 mass ppm sulfur, and operating said engine system using a lubricant composition as a lubricant for said diesel engine system, said lubricant composition comprising:

a lubricant base oil, and additives including:

(A) a metal detergent including at least one of alkaline earth metal salicylate and an overbased or basic salt thereof, (B) an ashless dispersant comprising both a boron-containing ashless dispersant and a boron-free ashless dispersant, and (C) a phosphorus-based anti-wear agent consisting of metal mono- or dihydrocarbyl phosphate, wherein said lubricant composition satisfies all of the following conditions (1) to (4):

(1) a sulfated ash content of 0.4 to 1.2 mass %, (2) an atomic ratio of metal derived from component (A) to the total phosphorus (M/P ratio) of 0.4 to 2, (3) an atomic ratio of the total boron to metal derived from component (A) (B/M ratio) of 0.2 to 2, and (4) an atomic ratio of the total sulfur to metal derived from component (A) (S/M ratio) of 0 to 4, and wherein the composition does not include a thiophosphate.

4. The method according to claim 3, wherein said regenerative DPF is a continuous regenerative DPF intended for mounting on a motor vehicle.

* * * * *